US008240296B2

(12) United States Patent
Marushima et al.

(10) Patent No.: US 8,240,296 B2
(45) Date of Patent: Aug. 14, 2012

(54) LUBRICATION DEVICE FOR GAS ENGINE

(75) Inventors: Hiroyoshi Marushima, Kanagawa (JP); Makoto Sakaguchi, Kanagawa (JP); Daisuke Tanioka, Kanagawa (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 173 days.

(21) Appl. No.: 12/867,386

(22) PCT Filed: Oct. 16, 2009

(86) PCT No.: PCT/JP2009/067887

§ 371 (c)(1), (2), (4) Date: Aug. 27, 2010

(87) PCT Pub. No.: WO2010/050367

PCT Pub. Date: May 6, 2010

(65) Prior Publication Data

US 2010/0313843 A1 Dec. 16, 2010

(30) Foreign Application Priority Data

Oct. 28, 2008 (JP) ..... 2008-276964

(51) Int. Cl.
*F01M 13/04* (2006.01)

(52) U.S. Cl. ..... 123/572; 123/196 R

(58) Field of Classification Search ..... 123/572–54, 123/41.86, 196 R, 196 A, 196 CP
See application file for complete search history.

(56) References Cited

U.S. PATENT DOCUMENTS 4,393,823 A 7/1983 Furukawa et al.
4,493,295 A * 1/1985 Ampferer ..... 123/41.86
(Continued)

FOREIGN PATENT DOCUMENTS

JP 49-1735 1/1974
(Continued)

OTHER PUBLICATIONS

International Search Report issued Jan. 26, 2010 in International (PCT) Application No. PCT/JP2009/067887.

*Primary Examiner* — M. McMahon

(74) *Attorney, Agent, or Firm* — Wenderoth, Lind & Ponack, L.L.P.

(57) ABSTRACT

Providing a gas engine in which the drain oil in the blow-by gas as a lubricant is mixed into the air fuel-gas mixture, the lubricant actively lubricating the bearing surfaces of the wear parts such as the valve seats and valve guides as to the intake-air valve and the exhaust gas valve, so that the lubricating device improves the engine lubricating conditions. A lubrication device for a gas engine thereby a valve gear room 6 is formed on a cylinder head, including: a blow-by gas discharge pipe 3 through which the blow-by gas flowing into the valve gear room 6 is discharged; whereby, an oil mist separator 4 is arranged at the downstream side of the blow-by gas discharge pipe, the oil mist separator separating the drain oil and the air in the blow-by gas; the outlet regarding the drain oil from the oil mist separator communicates with an oil discharge device 1 through an oil pipe 3*s*, the an oil discharge device being arranged at an upstream side of a gas mixer 110 mixing the fuel gas with the intake air for the engine, the upstream being in relation to the intake air; the outlet regarding the air from the oil mist separator communicates with an air inlet of the air cleaner 25 for the engine intake air, through a breathing pipe 5.

3 Claims, 5 Drawing Sheets

U.S. PATENT DOCUMENTS

| | | | | |
|---|---|---|---|---|
| 4,920,930 | A * | 5/1990 | Sakano et al. | 123/41.86 |
| 5,487,371 | A * | 1/1996 | Beckman et al. | 123/572 |
| 2003/0000504 | A1 * | 1/2003 | Katayama et al. | 123/516 |

FOREIGN PATENT DOCUMENTS

| | | |
|---|---|---|
| JP | 50-101708 | 8/1975 |
| JP | 57-11209 | 1/1982 |
| JP | 2722120 | 6/1991 |
| JP | 10-9061 | 1/1998 |
| JP | 3962477 | 9/1999 |
| JP | 2008-8247 | 1/2008 |

* cited by examiner

Fuel gas
Blow-by gas
Exhaust gas
Drain oil
5a
25
5
103b
1u
3s
3b
3m
4
3
1
A
110
112
110a
103a
2b
117
2
23
22
24
3a
6v
6y
6
6u
24s
106a
104
103
102a
102
12
115
113
101
107
106
100
1p
1j
1s
S1
R
D

LUBRICATION DEVICE FOR GAS ENGINE

FIELD OF THE INVENTION

The present invention relates to a lubricating device for a gas engine that is provided with a valve gear room that is formed above a cylinder head.

BACKGROUND OF THE INVENTION

FIG. 5 shows an outline configuration of a lubricating system around an air intake device and a valve gear device as to a general gas engine.

In FIG. 5, the engine that is depicted with the numeral 100 is a four-stroke cycle gas-engine provided with a spark plug 113; thereby, the engine comprises a cylinder liner 102*a* in which a piston (not shown in FIG. 5) is guided so as to perform reciprocating movements, and a combustion chamber 101 that is formed below the undersurface of a cylinder head 106*a*, over the top surface of the piston, inside the inner surface of the cylinder liner 102*a*.

Further, the engine 100 comprises an intake-air port 103 that communicate with the combustion chamber 101, an intake-air valve 104 that opens and closes so as to control the intake air flow through the air intake-air port 103 into the combustion chamber 101, an exhaust gas port 106 that communicate with the combustion chamber 101, and an exhaust (gas) valve 107 that opens and closes so as to control the exhaust gas flow from the combustion chamber 101 to the exhaust gas port 106.

An intake air pressure-regulating device (a zero-governor) 112 regulates the pressure of the fuel gas; the fuel gas under the regulated pressure is supplied into a gas mixer (an air fuel-gas mixer) 110 through a fuel gas supply pipe 110*a*. In the air fuel-gas mixer 110, the fuel gas supplied through a fuel gas supply pipe 110*a* is mixed with the air supplied through an air (inducing) pipe 103*b*; thus, air fuel-gas mixture is formed; the formed air fuel-gas mixture is supplied to each intake-air port 103 of the engine.

Further, the air fuel-gas mixture reaches each intake air valve 104 through the corresponding intake-air port 103, and is charged into the combustion chamber 101 while the intake air valve is being opened.

As described above, in the gas mixer 110, mixing the fuel gas with the air supplied through an air (inducing) pipe 103*b* forms the air fuel-gas mixture that is supplied to the intake-air port 103.

The air fuel-gas mixture flows toward the intake air valve 104 from an intake air pipe 103*a* through the intake-air port 103, and is charged into the combustion chamber 101 while the intake air valve is being opened. Further, by use of the spark plug 113, the air fuel-gas mixture charged in the combustion chamber 101 ignites; thereby, the spark plug is installed in the cylinder so that the tip part (the spark gap) of the spark plug borders the dead space of the combustion chamber 101.

On the cylinder head 106*b*, a (cylinder) head cover 24 is placed; the head cover 24 is fastened to the cylinder head with a plurality of bolts; and, in the head cover 24, a valve gear room (a space) 6 is formed so that a partition 6*y* divides the valve gear room 6 into an upper room 6*v* and a lower room 6*u*. Further, the partition 6*y* is provided with a reed valve 24*s* through which only one-way oil mist flow (blow-by gas flow), namely the oil mist flow from the lower room 6*u* to the upper room 6*v*, is allowed.

The blow-by gas with oil mist streams into the lower room 6*u* through a blow-by gas entrance pipe 2, for instance, from a space inside the cylinder block of the engine; such blow-by gas flows into the upper room 6*v* through a reed valve 24 from the lower room 6*u*. In the next place, the blow-by gas is sent into an air cleaner 25 through a blow-by gas discharge pipe 3 from the upper room 6*v*.

Conventionally, there are many blow-by gas discharging means (systems) are shown.

According to the patent reference 1 (JP 2722120), the blow-by gas in the valve gear room 3 is returned back to the air inlet side of the gas mixer 8 through the breathing room 5 and the breathing pipe 12.

Further, in the patent reference 2 (JP 3962477), the blow-by gas in the valve gear room 102 returned back to the inlet side of the carburetor 111 through the breathing room 109 and the breathing pipe 132. Hereby, the numerals quoted are those quoted in the references 1 and 2 (not the numerals in the attached drawings).

In a case of a gas engine in comparison with a gasoline, the wear of the intake air valve (stem) guide as well as the exhaust gas valve (stem) guide becomes larger; further, the wear of the intake air valve seat as well as the exhaust gas valve seat becomes larger. A possible major reason is that the gasoline components in the air fuel mixture work as a lubricant in a case of a gasoline engine; on the contrary, the lubrication effect of the fuel in the air fuel mixture cannot be expected in a case of a gas engine.

Thus, in the gas engine as depicted in FIG. 5, there is a problem that the wear is prone to increase in relation to the contact area between the intake air valve cone 104 and the valve seat 115, between the intake air valve stem 104 and the valve stem guide 117, between the exhaust gas valve cone 107 and the valve seat 115, and between the exhaust gas valve stem 107 and the valve stem guide 117.

PRIOR ART DOCUMENTS

PATENT REFERENCE 1: JP2722120
PATENT REFERENCE 2: JP3962477

SUMMARY OF THE INVENTION

In view of the problems as described above, the present invention aims at providing a gas engine in which the drain oil in the blow-by gas as a lubricant is mixed into the air fuel-gas mixture, the lubricant actively lubricating the bearing surfaces of the wear parts such as the valve seats and valve guides as to the intake-air valve and the exhaust gas valve, so that the lubricating device improves the engine lubricating conditions.

In order to solve the problems as described above, the present invention discloses a lubrication device for a gas engine provided with a valve gear room formed on a cylinder head of the engine comprising:

a blow-by gas entrance pipe through which the blow-by gas generated in the gas engine flows into the valve gear room, and a blow-by gas discharge pipe through which the blow-by gas led into the valve gear room is discharged;

wherein an oil mist separator for separating the blow-by gas into drain oil and air is arranged at the downstream side of the blow-by gas discharge pipe;

the outlet for the drain oil from the oil mist separator communicates with an oil discharge device via an oil pipe, the oil discharge device being arranged at an upstream side in relation to the intake air of an air fuel-gas mixer for mixing the fuel gas with the intake air for the engine; and the outlet for the air from the oil mist separator communicates with an air inlet of the air cleaner for the engine intake air via an air pipe.

In the present invention, a preferable embodiment is the lubrication device for a gas engine, wherein the oil discharge device comprises a flow speed accelerating means that is arranged inside the oil discharge device for increasing the speed of the intake airflow toward the air fuel-gas mixer;

the pressure inside the blow-by gas discharge pipe is reduced to a negative pressure by use of the flow speed accelerating means so that the discharge of the blow-by gas through the blow-by gas discharge pipe is easily performed.

Another preferable embodiment is the lubrication device for a gas engine, wherein the blow-by gas entrance pipe is arranged in a lower open hole provided at a lower part of the valve gear room so that the blow-by gas flows into the valve gear room through the blow-by entrance pipe in the open hole, and the oil mist separator is connected to an upper open hole via the blow-by gas discharge pipe, the upper open hole formed at a location higher than where the blow-by gas entrance pipe is arranged in the valve gear room so that the blow-by gas is led to flow into the blow-by discharge pipe.

EFFECT OF THE INVENTION

According to the above disclosure of the present invention, the gas engine is provided with the lubrication device thereby a valve gear room is formed on a cylinder head of the engine, the lubrication device comprising:

a blow-by gas entrance pipe through which the blow-by gas generated in the gas engine flows into the valve gear room, and a blow-by gas discharge pipe through which the blow-by gas flowing into the valve gear room is discharged;

whereby, an oil mist separator is arranged at the downstream side of the blow-by gas discharge pipe, the oil mist separator separating the drain oil and the air in the blow-by gas;

the outlet regarding the drain oil from the oil mist separator communicates with an oil discharge device through an oil pipe, the an oil discharge device being arranged at an upstream side of an air fuel-gas mixer mixing the fuel gas with the intake air for the engine, the upstream being in relation to the intake air;

the outlet regarding the air from the oil mist separator communicates with an air inlet of the air cleaner for the engine intake air, through a breathing pipe.

Accordingly, the lubricating conditions as to the wear parts (such as the intake air valve and the exhaust gas valve that configure the combustion chamber) can be improved thanks to the drain oil (that acts as a lubricant) in the blow-by gas supplied through the blow-by gas discharge pipe.

Further, as per the present invention, the blow-by gas that is conducted from the valve gear room through the blow-by gas discharge pipe, toward the oil mist separator through which the blow-by gas is separated into the air (gas) and the drain oil; the air (gas) is sent to the air inlet of the air cleaner, while the drain oil is sent to the oil discharge device; the drain oil flows into the intake air only through the oil discharge device 1 that is placed at the immediate upstream side of the air fuel-gas mixer; the drain oil is mixed into the intake air of the engine at the oil discharge device, and the intake air including the drain oil is mixed with the fuel-gas at the air fuel-gas mixer. In this way, the drain oil can be surely and effectively mixed into the air fuel-gas mixture.

Further, according to the present invention, the blow-by gas is not mixed directly into the intake air but via the oil mist separator; hence, the feeding rate of the drain oil into the engine can be controllable. For instance, the drain oil may be temporarily accumulated in a vessel; and, the drain oil may be controllably supplied to the oil discharge device 1.

Therefore, the drain oil in the blow-by gas as a lubricant is mixed into the air fuel-gas mixture, the lubricant actively lubricating the bearing surfaces of the wear parts such as the valve seats and valve guides as to the intake-air valve and the exhaust gas valve; the wear as to these parts or these bearing surfaces can be constrained; and, the durability a well as the reliability regarding the intake air valve and the exhaust gas valve can be enhanced.

According to the preferable embodiment described above, the gas engine is provided with the lubrication device for a gas engine, whereby the oil discharge device comprises a flow speed accelerating means that is arranged inside the oil discharge device and increases the speed of the intake airflow toward the air fuel-gas mixer;

the pressure inside the oil pipe is reduced to a negative pressure by use of the flow speed accelerating means so that the discharge of the blow-by gas through the blow-by gas discharge pipe is easily performed.

Consequently, by providing the flow speed accelerating means that is arranged inside the oil discharge device and increases the speed of the intake airflow toward the air fuel-gas mixer, the flow of the blow-by gas from the valve gear room can be smoothly discharged; the amount of the drain oil that is separated the oil mist separator (and drops into the oil discharge device) can be increased; therefore, the influx of the drain oil into the air fuel-gas mixture is further actively promoted, and a sufficient abundance of lubricating oil (the drain oil) can be supplied into the combustion chamber.

According to the another preferable embodiment, the gas engine is provided with the lubrication device for a gas engine, the valve gear room being provided with an open hole at a lower part of the valve gear room and an opening hole at a higher part of the valve gear room, the location of the opening hole being higher than the location of the open hole;

whereby, the blow-by gas flows into the valve gear room through the blow-by gas entrance pipe that communicates with the open hole;

the blow-by gas discharges from the valve gear room through the blow-by gas discharge pipe that communicates with the opening hole.

Therefore, the blow-by gas entrance pipe is connected to the lower part of the valve gear room, and the blow-by gas discharge pipe is connected to the upper part of the valve gear room; thus, a blow-by gas passage is formed from the blow-by gas entrance pipe at the lower part of the valve gear room toward the blow-by gas discharge pipe at the upper part of the valve gear room, through the valve gear room; as a result, a smooth blow-by gas flow is can be realized.

DETAILED DESCRIPTION OF THE PREFERRED EMBODIMENTS

Hereafter, the present invention will be described in detail with reference to the embodiments shown in the figures. However, the dimensions, materials, shape, the relative placement and so on of a component described in these embodiments shall not be construed as limiting the scope of the invention thereto, unless especially specific mention is made.

Figures 1A, 1B:
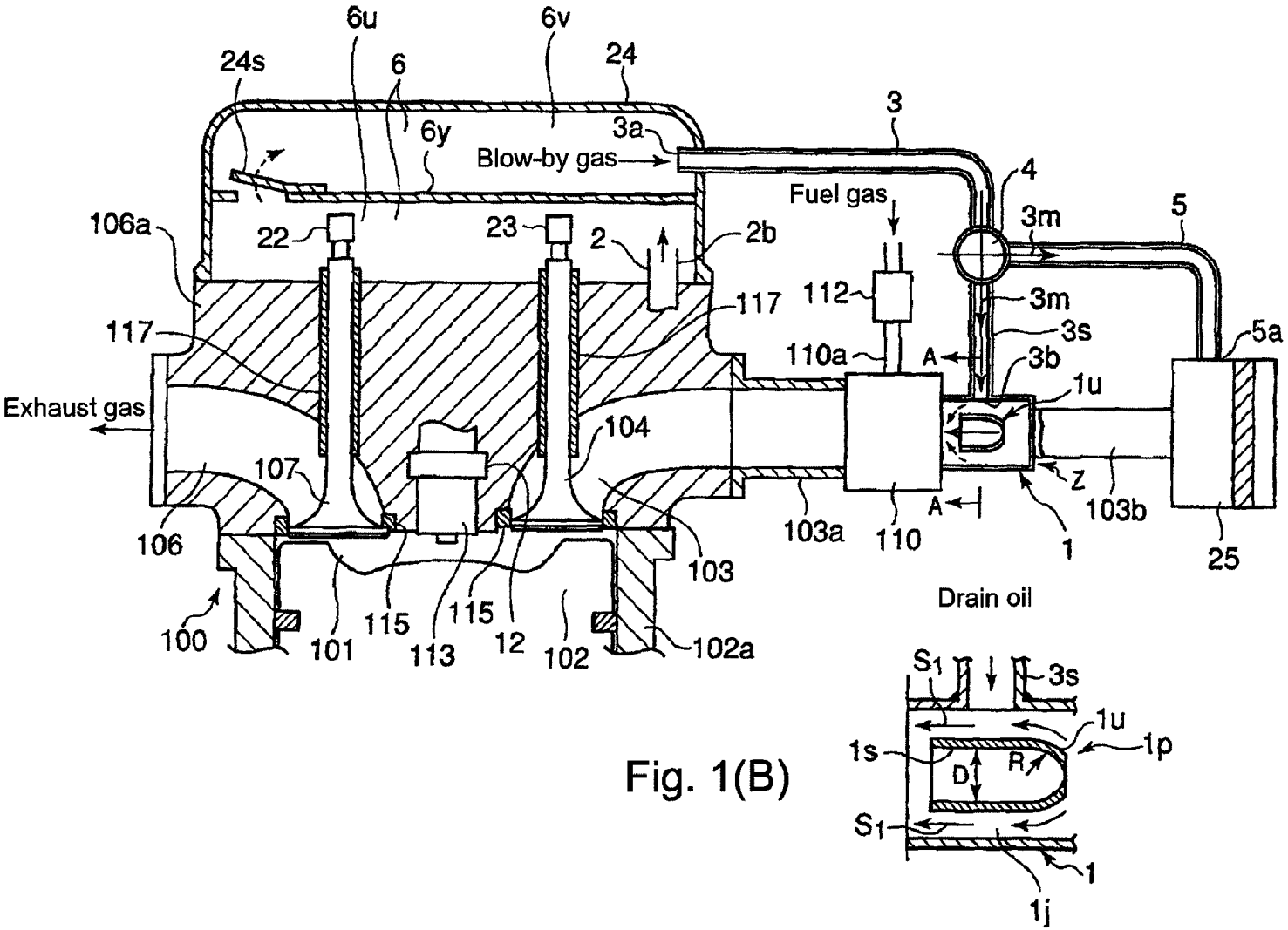
FIG. 1(A) shows the configuration of a gas engine around the combustion chamber thereof, according to an embodiment of the present invention.
FIG. 1(B) shows an enlargement of the part Z in FIG. 1(A)
Figure 2:
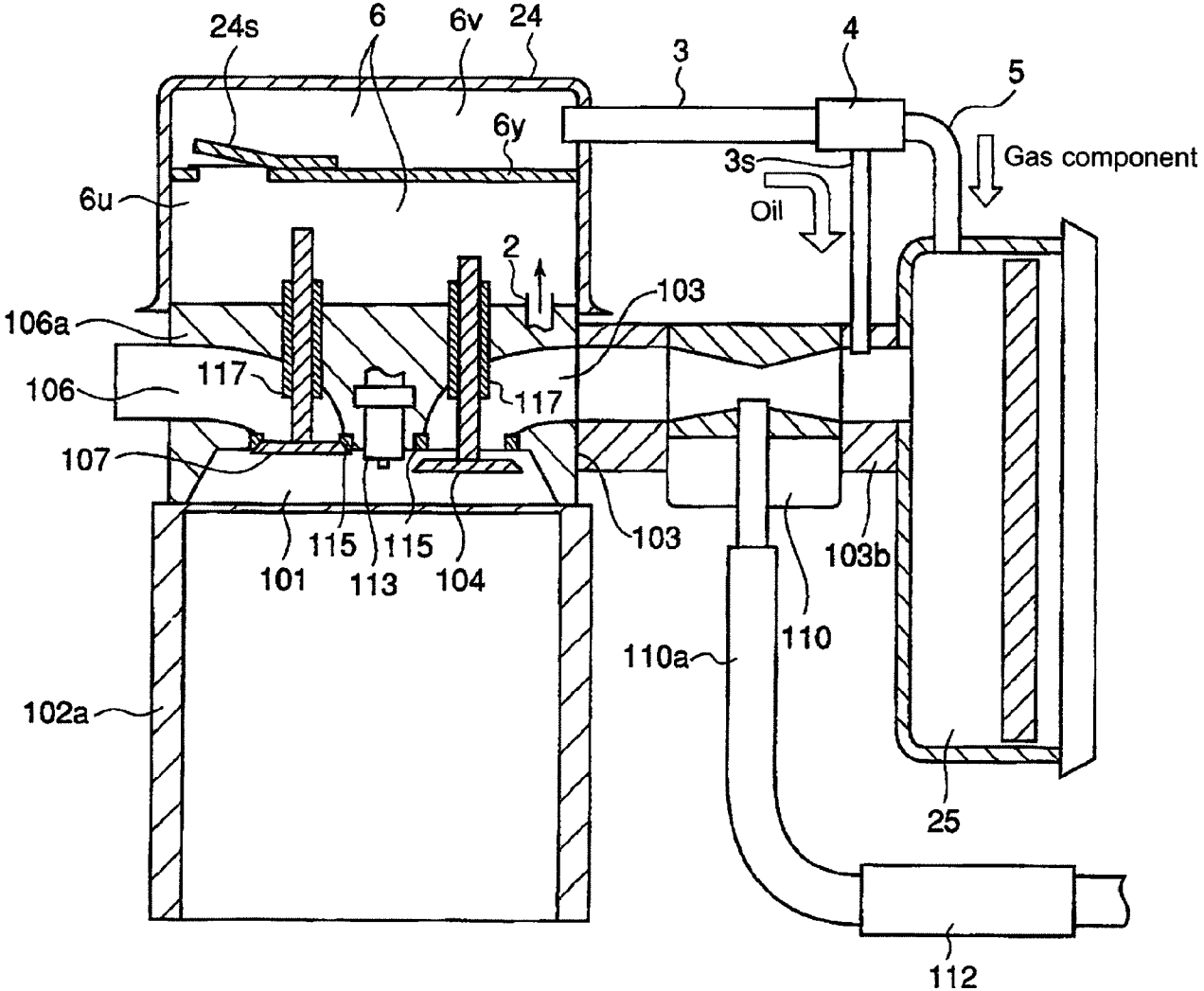
FIG. 2 shows the configuration as to FIG. 1(A), according to the embodiment of the present invention.
Figure 3:
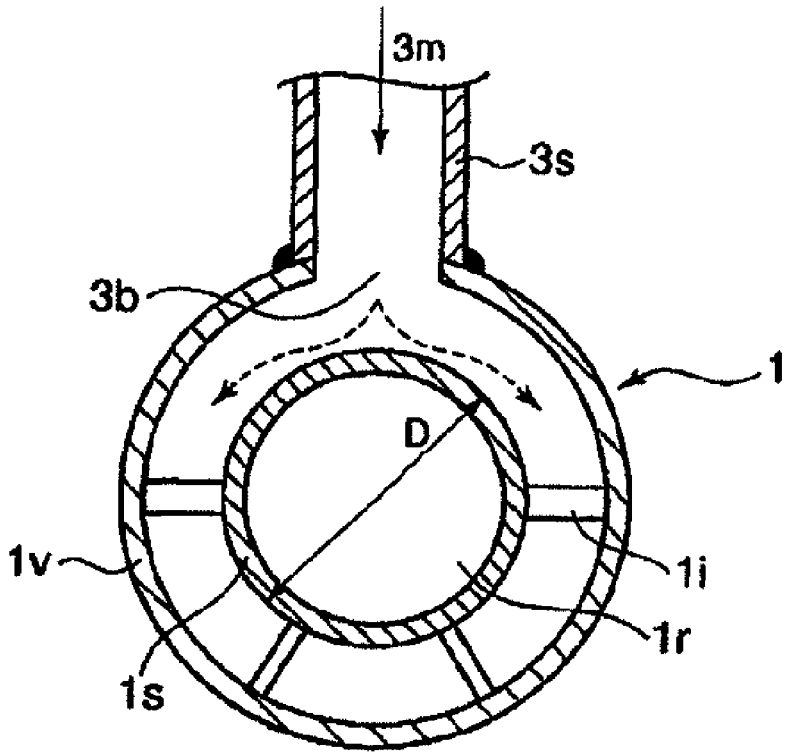
FIG. 3 shows an A-A cross-section of FIG. 1(A), according to the embodiment of the present invention.
Figure 4:
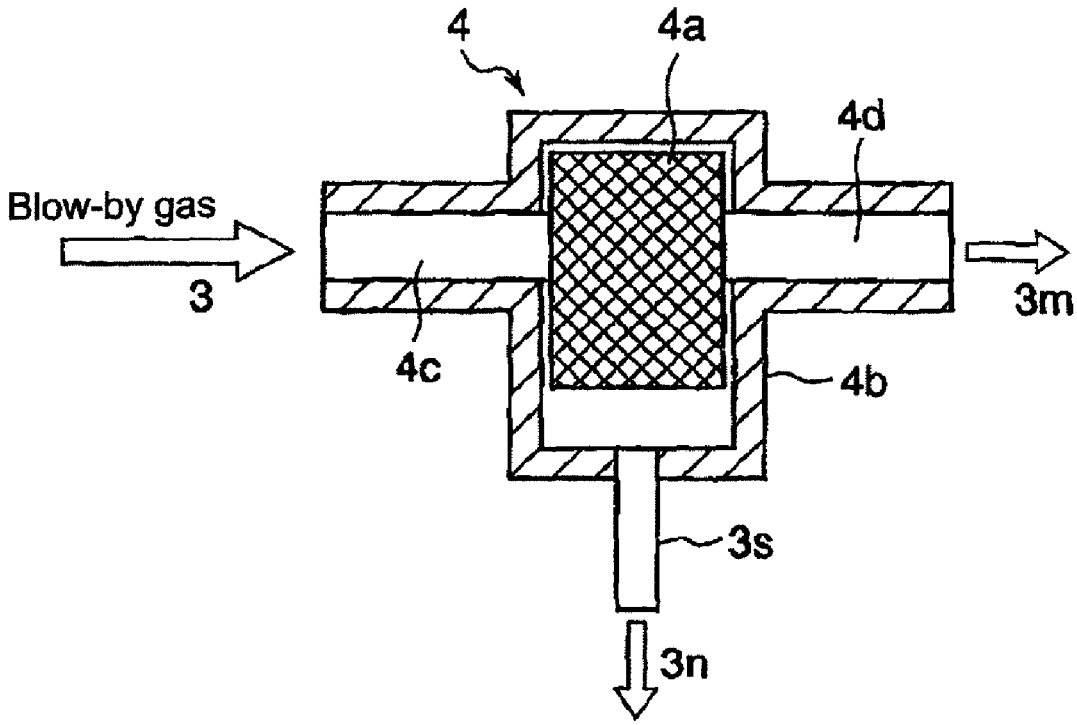
FIG. 4 shows an enlargement of an oil mist separator, according to the embodiment of the present invention.
Figure 5:
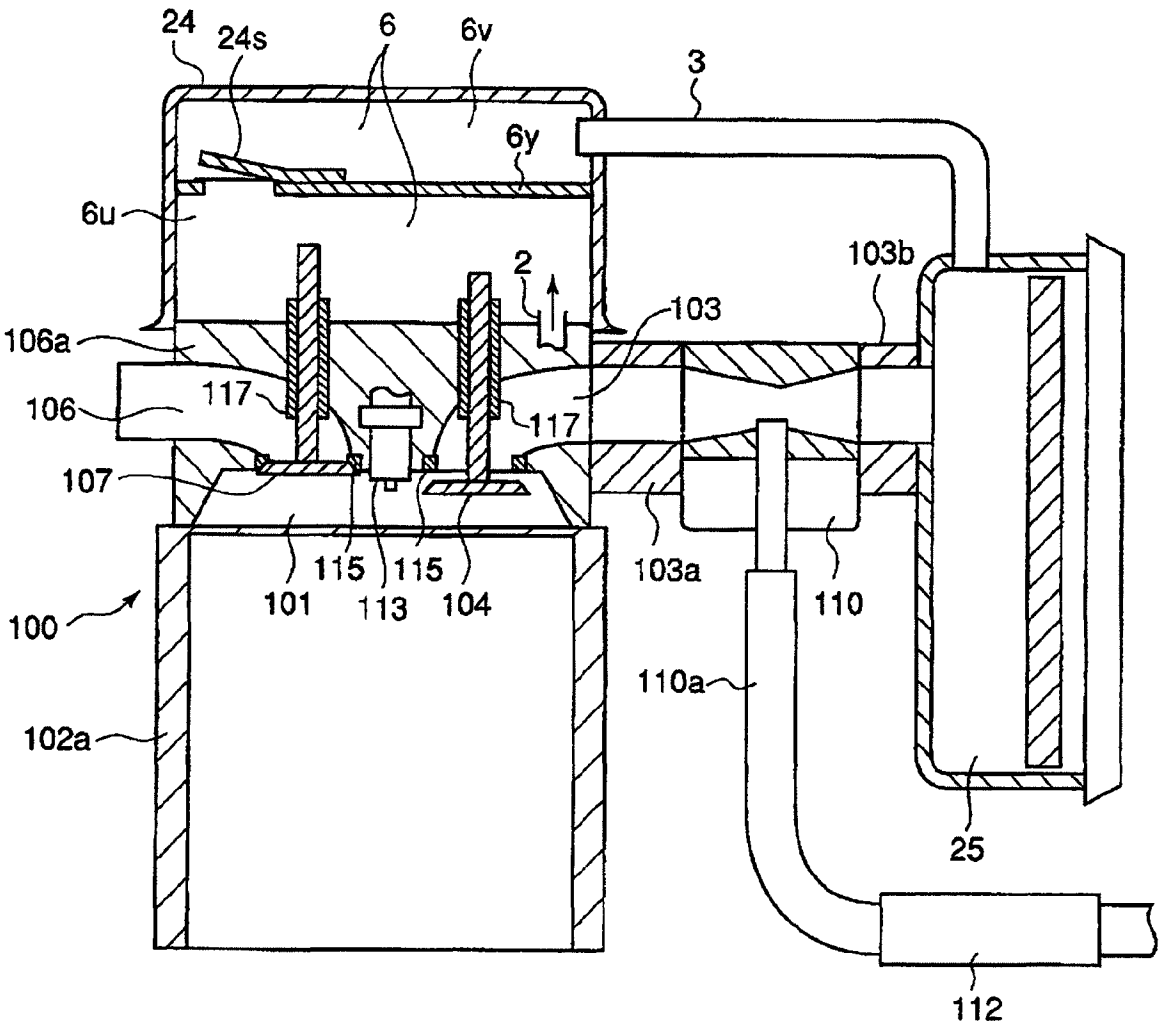
FIG. 5 shows a conventional technology in response to FIG. 2.

FIG. 1(A) shows the configuration of a gas engine around the combustion chamber thereof, according to an embodiment of the present invention; FIG. 1(B) shows an enlargement of the part Z in FIG. 1(A); FIG. 2 shows the configuration as to FIG. 1(A), according to the embodiment of the present invention; FIG. 3 shows an A-A cross-section of FIG. 1(A), according to the embodiment of the present invention; FIG. 4 shows an enlargement of an oil mist separator, according to the embodiment of the present invention.

In FIGS. 1(A) and 1(B) and FIG. 2, an engine (a gas engine) denoted by the numeral 100 is a four-stroke cycle gas engine provided with a spark plug 113, comprising a cylinder liner 102*a* in which a piston 102 is guided so as to perform reciprocating movements, and a combustion chamber 101 that is formed below an undersurface of a cylinder head 106*a*, over the top surface of the piston, inside the inner surface of the cylinder liner 102*a*.

Further, the engine 100 comprises an intake-air port 103 that communicates with the combustion chamber 101, an intake air valve 104 that opens and closes the air intake-air port 103, an exhaust gas port 106 that communicates with the combustion chamber 101, and an exhaust (gas) valve 107 that opens and closes the exhaust gas port 106.

An intake air pressure-regulating device (a zero-governor) 112 regulates the pressure of the fuel gas before the fuel gas is supplied to a gas mixer 110 through a fuel gas supply pipe 110*a*. In the gas mixer 110, the fuel gas supplied through a fuel gas supply pipe 110*a* is mixed with the air supplied through an air (inducing) pipe 103*b* to generate air fuel-gas mixture, and the air fuel-gas mixture generated in the gas mixer 110 is supplied to the intake-air port 103 of the engine.

Further, the air fuel-gas mixture reaches the intake air valve 104 through the intake-air port 103, and is charged into the combustion chamber 101 when the intake air valve is being opened.

As described above, the fuel gas is mixed with the air supplied through the air pipe 103*b* in the gas mixer 110 to generate the air fuel-gas mixture that is supplied to the intake-air port 103.

The air fuel-gas mixture flows toward the intake air valve 104 from an intake air pipe 103*a* through the intake-air port 103, and is charged into the combustion chamber 101 while the intake air valve 104 is being opened. Further, by use of the spark plug 113, the air fuel-gas mixture charged in the combustion chamber 101 is ignited, and the exhaust gas due to the combustion of the air fuel-gas mixture in the chamber 101 is led directly to the outside through the exhaust gas port 106 and through an exhaust gas pipe.

On the cylinder head 106*a*, a head cover 24 is placed fastened to the cylinder head with a plurality of bolts. In the head cover 24, a valve gear room 6 is formed having a partition 6*y* for dividing the valve gear room 6 into an upper room 6*v* and a lower room 6*u*. Further, the partition 6*y* is provided with a reed valve 24*s* which allows oil mist to flow only in one way from the lower room 6*u* to the upper room 6*v*.

Blow-by gas with oil mist flows into the lower room 6*u* through a blow-by gas entrance pipe 2, for instance, from a space inside a cylinder block of the engine. The blow-by gas flows into the upper room 6*v* through the reed valve 24 from the lower room 6*u*, and then, the blow-by gas is sent toward a blow-by gas discharge pipe 3 from the upper room 6*v*.

The configuration described above is the same as the configuration in the conventional technologies. The present invention relates to a lubricating device (system) connected to the valve gear room (a space) in which valve gears are housed.

In FIGS. 1(A), 1(B) and 2, as described above, the blow-by gas with oil mist flows into the lower room 6*u* at the lower part thereof through a blow-by gas entrance pipe 2, for instance, from a space inside the cylinder block of the engine. Further, the blow-by gas discharge pipe 3 is provided so as to connect the upper room 6*v* with the upstream side of the charging air flow of the air fuel-gas mixer 110.

On the other hand, the upper room 6*v* which is located higher than an open hole part 2*b* of the blow-by gas entrance pipe 2 is provided with an open hole part 3*a* for the blow-by gas discharge pipe 3 so that the blow-by gas in the upper room 6*v* is led to the blow-by gas discharge pipe 3 through the open hole part 3*a*.

In this way, the open hole part 2*b* of the blow-by gas entrance pipe 2 is connected to the lower room 6*u*, and the open hole part 3*a* of the blow-by gas discharge pipe 3 is connected to the upper room 6*v*. Accordingly, a blow-by gas passage is formed from the blow-by gas entrance pipe 2 to the blow-by gas discharge pipe 3 through the lower room 6*u*, the reed valve 24, and the upper room 6*v* in order. As a result, a smooth blow-by gas flow is can be realized.

Further, at the downstream side of the blow-by gas discharge pipe 3, an oil mist separator 4 is arranged so that the oil mist separator 4 separates the blow-by gas that flows through the blow-by gas discharge pipe 3 into drain oil and air from.

As shown in FIG. 4, the oil mist separator 4 is provided with a filter 4*a* that is housed in a'case 4*b* so that the blow-by gas flown into the oil mist separator 4 through an inlet 4*c* thereof that is connected to the blow-by gas discharge pipe 3 is purified by the filter 4*a*.

The drain oil 3*n* being filtered out of the filter 4*a* drops in the downward direction from the oil mist separator 4 toward an oil discharge device 1, through an oil pipe 3*s*. In addition, the air 3*m* separated in the oil mist separator 4 is sent to an air inlet 5*a* of the air cleaner 25 from an air outlet 4*d* of the oil mist separator 4, through an air pipe 5.

As described above, by letting the blow-by gas discharged from the valve gear room 6 pass through the oil mist separator 4 that separates the blow-by gas into the drain oil 3*n* and the air 3*m* after the blow-by gas has passed through the blow-by gas discharge pipe 3, the blow-by gas can be separated accurately into the drain oil 3*n* and the air 3*m*.

Further, while the air 3*m* is sent to the air inlet 5*a* of the air cleaner 25, the drain oil 3*n* drops in the downward direction from the oil mist separator 4 toward an oil discharge device 1, through an oil pipe 3*s*.

Hence, the drain oil 3*n* and the air 3*m* in the blow-by gas can be reliably separated.

Further, as shown in FIGS. 1(B) and 3, the oil discharge device 1 to which the oil pipe 3*s*, which is an outlet of the oil mist separator 4 for the drain oil, is directly connected is provided with a flow speed accelerating means 1*p* by which the flow speed of the air stream toward the gas mixer 110 is accelerated.

To be more specific, the flow speed accelerating means 1*p* is provided with a reducing pipe is (having a hollow space 1*r* therein) of a barrel shape; an air inlet side 1*u* of the flow speed accelerating means 1*p* forms a reduced throat (an inlet throat) so that the air flow rate through the hollow space 1*r* inside the reducing pipe is restrained. Hence, the air charged into the flow speed accelerating means 1*p* flows mainly through a throttle passage 1*j* formed around the outer periphery of the reducing pipe is; thereby, the airflow speed of the air 3*m* is increased in comparison with the airflow speed at the time when the air has entered the oil discharge device 1.

Further, by changing the diameter D of the reducing pipe 1*s*, the throttle area (a cross-section area) as to the throttle passage 1*j* can be changed (the larger the diameter D, the narrower the throttle passage 1*j*, and the higher the airflow speed).

In addition, as shown in FIG. 3, the reducing pipe is supported by a plurality of ribs 1*i* that are connected to an outer periphery circular-member 1*v*.

Accordingly, the drain oil 3*n* that is separated by the oil mist separator 4 and has dropped through the oil pipe 3*s* is drawn into the throttle passage 1*j* due to an ejector effect (a negative pressure effect) caused by the air being passed through the throttle valve 1*j* and the airflow speed therein being accelerated.

Thus, the drain oil 3*n* in the oil pipe 3*s* as well as in the blow-by gas discharge pipe 3 at the upstream side of the oil pipe 3*s* is drawn into the airflow through the throttle passage 1*j* in which the airflow speed is accelerated by the flow speed accelerating means 1*p*; and, the drain oil is guided to the gas mixer 110.

In this way, by use of the flow speed accelerating means 1*p*, the blow-by gas passing through the blow-by gas discharge pipe 3 can be smoothly discharged and guided toward the intake-air port 103.

According to the embodiment as described thus far, in the present invention, the blow-by gas discharge pipe 3 is provided for discharging the blow-by gas flowing into the valve gear room, and the oil mist separator 4 for separating the drain oil and air in the blow-by gas is arranged at the downstream side of the blow-by gas discharge pipe 3. The outlet for the drain oil from the oil mist separator 4 is communicated, via the oil pipe 3*s*, with the oil discharge device 1 which is located at the upstream side of an air fuel-gas 110, while the outlet for the air from the oil mist separator 4 is communicated, via the air pipe 5, with the air cleaner 25.

While letting the blow-by gas generated in the gas engine, for instance, in the cylinder block flowed into the valve gear room 6 through the blow-by gas entrance pipe 2, the blow-by gas in the valve gear room 6 is discharged toward the oil mist separator 4 through the blow-by gas discharge pipe 3 so that the blow-by gas is led to the oil mist separator 4 to be separated into the drain oil and air, and the air is communicated to the air inlet 5*a* of the air cleaner 25 via the air pipe 5, and the drain oil is dropped downward to the oil discharge device 1 via the oil pipe 3*s*. In this way, the amount of the drain oil dropping into the oil discharge device 1 can be increased; therefore, the influx of the drain oil into the air fuel-gas mixture is further actively promoted, and a sufficient abundance of lubricating oil can be supplied into the combustion chamber.

Consequently, the lubricating oil supply can be enhanced toward the intake air valve 104, the exhaust gas valve 107, valve seats 115 and a valve stem guide 117; the wear as to these parts of the engine 100 can be constrained, and the durability as well as the reliability regarding the intake air valve 104 and the exhaust gas valve 107 can be enhanced.

Further, after the blow-by gas passes the oil mist separator 4 that separates the blow-by gas into the air and the drain oil, only the drain oil is sent to the immediate upstream side of the air fuel-gas mixer 110; thus, the drain oil can be more smoothly supplied to the engine (hereby, the intake air pipe 103*b*) in comparison to a case where the drain oil from the oil mist separator is sent to the downstream side of the air fuel-gas mixer 110; the reason is that the drain oil supply into the engine is prone to be influenced by the pressure pulsation of the intake air, when the location of the drain oil supply is near to the cylinder (i.e. the intake-air port).

Accordingly, the lubricating conditions as to the wear parts (such as the intake air valve and the exhaust gas valve) that configure the combustion chamber 101 can be improved thanks to the drain oil (that acts as a lubricant) in the blow-by gas supplied through the blow-by gas discharge pipe 3.

Further, as per the present invention, the blow-by gas that is conducted from the valve gear room 6 through the blow-by gas discharge pipe 3, toward the oil mist separator 4 through which the blow-by gas is separated into the air and the drain oil; the air is sent to the air inlet 5*a* of the air cleaner 25, while the drain oil is sent to the oil discharge device 1; the drain oil flows into the intake air only through the oil discharge device 1 that is placed at the immediate upstream side of the air fuel-gas mixer 110; the drain oil is mixed into the intake air of the engine at the oil discharge device 1, and the intake air including the drain oil is mixed with the fuel-gas at the air fuel-gas mixer 110. In this way, the drain oil can be surely and effectively mixed into the air fuel-gas mixture.

Further, according to the present invention, the blow-by gas is not mixed directly into the intake air but via the oil mist separator 4; hence, the feeding rate of the drain oil into the engine can be controllable. For instance, the drain oil may be accumulated in a vessel (not shown); and, the drain oil may be controllably supplied to the oil discharge device 1.

INDUSTRIAL APPLICABILITY

In the lubricating device according to the present invention, the drain oil in the blow-by gas as a lubricant is mixed into the air fuel-gas mixture, the lubricant actively lubricating the bearing surfaces of the wear parts such as the valve seats and valve guides as to the intake-air valve and the exhaust gas valve. Thus, the lubricating device improves the engine lubricating conditions, and is suitable for gas engines.

The invention claimed is:

1. A lubrication device for a gas engine provided with a valve gear room formed on a cylinder head of the engine comprising:

a blow-by gas entrance pipe through which the blow-by gas generated in the gas engine flows into the valve gear room, and a blow-by gas discharge pipe through which the blow-by gas led into the valve gear room is discharged;

wherein an oil mist separator for separating the blow-by gas into drain oil and air is arranged at the downstream side of the blow-by gas discharge pipe;

the outlet for the drain oil from the oil mist separator communicates with an oil discharge device via an oil pipe, the oil discharge device being arranged at an upstream side in relation to the intake air of an air fuel-gas mixer for mixing the fuel gas with the intake air for the engine; and the outlet for the air from the oil mist separator communicates with an air inlet of the air cleaner for the engine intake air via an air pipe.

2. The lubrication device for a gas engine according to claim 1, wherein the oil discharge device comprises a flow speed accelerating means that is arranged inside the oil discharge device for increasing the speed of the intake airflow toward the air fuel-gas mixer;

the pressure inside the blow-by gas discharge pipe is reduced to a negative pressure by use of the flow speed accelerating means so that the discharge of the blow-by gas through the blow-by gas discharge pipe is easily performed.

3. The lubrication device for a gas engine according to claim 1, wherein the blow-by gas entrance pipe is arranged in a lower open hole provided at a lower part of the valve gear room so that the blow-by gas flows into the valve gear room through the blow-by entrance pipe in the open hole, and the oil mist separator is connected to an upper open hole via the blow-by gas discharge pipe, the upper open hole formed at a location higher than where the blow-by gas entrance pipe is arranged in the valve gear room so that the blow-by gas is led to flow into the blow-by discharge pipe.

* * * * *